US008186532B2

(12) United States Patent
Shinguryo et al.

(10) Patent No.: US 8,186,532 B2
(45) Date of Patent: May 29, 2012

(54) CAN LID

(75) Inventors: Takuro Shinguryo, Gotenba (JP); Kazuhiro Taguchi, Gotenba (JP); Kenichi Shibata, Gotenba (JP); Hideki Ito, Gotenba (JP)

(73) Assignee: Universal Can Corporation, Tokyo (JP)

( * ) Notice: Subject to any disclaimer, the term of this patent is extended or adjusted under 35 U.S.C. 154(b) by 1370 days.

(21) Appl. No.: 11/576,330

(22) PCT Filed: Sep. 21, 2005

(86) PCT No.: PCT/JP2005/017410

§ 371 (c)(1), (2), (4) Date: Mar. 29, 2007

(87) PCT Pub. No.: WO2006/035653

PCT Pub. Date: Apr. 6, 2006

(65) Prior Publication Data

US 2007/0215621 A1 Sep. 20, 2007

(30) Foreign Application Priority Data

Sep. 30, 2004 (JP) ..... 2004-286726

(51) Int. Cl.
*B65D 17/34* (2006.01)

(52) U.S. Cl. ..... 220/269; 220/906; 413/16; 413/66

(58) Field of Classification Search ..... 220/269, 220/906; 413/12, 14, 15, 16, 17, 56, 66
See application file for complete search history.

(56) References Cited

U.S. PATENT DOCUMENTS

| | | | | |
|---|---|---|---|---|
| 5,494,184 | A | 2/1996 | Noguchi et al. | |
| 5,819,973 | A * | 10/1998 | Traub et al. | 220/271 |
| 2003/0111469 | A1 * | 6/2003 | Hartman et al. | 220/269 |

FOREIGN PATENT DOCUMENTS

| | | | |
|---|---|---|---|
| JP | 4-44950 | A | 2/1992 |
| JP | 7-44595 | Y2 | 10/1995 |
| JP | 8-11882 | A | 1/1996 |
| JP | 8-164935 | A | 6/1996 |
| JP | 2508637 | U | 6/1996 |
| JP | 3468548 | B2 | 9/2003 |

OTHER PUBLICATIONS

International Search Report for PCT/JP2005/017410 mailed Dec. 6, 2005.

* cited by examiner

*Primary Examiner* — Anthony Stashick
*Assistant Examiner* — James N Smalley
(74) *Attorney, Agent, or Firm* — Leason Ellis LLP.

(57) ABSTRACT

In this can lid, a rivet-slanting inhibitor which flows a metal of the can lid main body located between the rivet to the rivet side thereby correcting or preventing the slanting of the rivet is formed on a location in an opposite area which is opposed to an opening part across the rivet except for the coining part.

10 Claims, 6 Drawing Sheets

CAN LID

CROSS REFERENCE TO PRIOR APPLICATIONS

This is a U.S. national phase application under 35 U.S.C.§371 of International Patent Application No. PCT/JP2005/017410 filed Sep. 21, 2005, and claims the benefit of Japanese Application No. 2004-286726 filed Sep. 30, 2004, both of them are incorporated by reference herein. The International Application was published in Japanese on Apr. 6, 2006 as International Publication No. WO 2006/035653 under PCT Article 21(2).

TECHNICAL FIELD

The present invention relates to a can lid which is wound and fastened to an opening of a can body.

BACKGROUND ART

A can lid of this type generally consists of a rivet and dimples which are gibbously and upwardly shaped, an opening which is demarcated by a main score and arranged across the rivet for the dimples, and a tab which is fixed to the rivet such that one end part thereof overlaps the opening and the other end thereof overlaps the dimples on an upper surface of the can lid main body. On the other end of the tab, a finger hole is perforated in a thickness direction.

In general, two dimples are formed on the upper surface of the can lid main body, and each of these dimples is located so as to face each other across a straight line which connects the center of the opening or the tab in the width direction with the center line of the can lid main body. These dimples support the lower surface of the tab, such that the tab is prevented from rotating, even when a force which rotates the tab around the rivet acts thereon.

The can lid thus constituted is wound and fastened to a can body so as to form a can which is filled with a content. The can is constructed such that when an outwall part (referred to as "a pull-up part", hereinafter), which is located on the other end of the tab, of the pull-up part which forms a finger hole of the tab, is pulled up by a consumer, then one end part of the tab pushes the opening and breaks a main score thereby perforating the opening. Here, a part of the main score is located on a coining part which is constituted to be harder than the other part, which is a periphery of the rivet, which is contiguous to the rivet on the upper surface of the can lid main body, and constructed such that the main score can easily be broken when pulling up the pull-up part of the tab.

Incidentally, hitherto there has been a problem in that a finger hardly enters into a gap between the upper surface of the can lid main body and the pull-up part of the tab and hence it is difficult to pull up the pull-up part successfully. Hitherto, as is disclosed in the following documents Japanese Examined Utility Model Application No. 7-44595; Japanese Unexamined Patent Application, First Publication No. 4-44950; Japanese Utility Model (Granted) Publication No.2508637; Japanese Patent (Granted) Publication No. 3,468,548, various means for solving this problem have been proposed.

At first, Japanese Examined Utility Model Application No. 7-44595 1 has disclosed an invention which consists of a recess for inserting one's finger and extending it into the radial direction of the can lid main body from a ring-like groove which constitutes the outer periphery of the upper surface of the can lid main body, underneath the pull-up part of the tab.

Although, it becomes easy to insert one's finger into the gap between the upper surface of the can lid inserting one's finger and the pull-up part in accordance with the invention, the invention is not applicable to the case in which pressure in the can is high this is because the compressive strength of the can lid may deteriorate since the recess for inserting one's finger is extended from the ring-like groove to the right under the pull-up part. Moreover, plural can lids are stacked and transferred through a tube in the production process of the can lid. When transferring the can lids, a lower surface of a recess for inserting one's finger comes into contact with an upper surface of a tab of the other can lid which is located facing the lower surface so as to form a space between curling parts of the can lids which are adjacent to each other in a stacking direction, i.e. an accordion-like situation, and as a result, stacking performance deteriorates and it becomes difficult to provide favorable transferring performance.

In addition, there has been a case that liquid paraffin which has been adhered to the tab of another can lid is transferred to the lower surface of the recess for inserting one's finger in the one can lid which is located facing the tab. There has been a problem in that if the content is poured from the can in which one can lid has been wound and fastened into the other vessel, then it becomes difficult that the content sparkle in the case in which the content is for example beer.

Next, Japanese Unexamined Patent Application, First Publication No. 4-44950 disclosed a can lid which is equipped with a two-stage shape such that the lower surface of one end comes into contact with the upper surface of the can lid main body, and simultaneously the lower surface of another end departs upwardly from the upper surface of the can lid main body.

Since a gap has been formed between the lower surface of another end of the tab having a pull-up part and the upper surface of the can lid main body in the present invention, it is possible to insert one's finger easily into the gap, thereby realizing a favorable opening property.

However, there is a problem in that it is difficult to provide favorable transferring performance and foaming performance, similar to the can lid disclosed in Patent document 1, because the upper surface of the tab of one can lid comes into contact with the lower surface of another can lid which is placed facing the can lid, when transferring the can lid through a tube in the production process of a can lid.

Next, Japanese Utility Model (Granted) Publication No.2508637 disclosed an invention in which a secondary-score is formed at a location which is opposed to the pull-up part of the tab in the upper surface of the can lid main body.

In accordance with the invention, it is possible to prevent the gap between the pull-up part and the upper surface of the can lid from decreasing when the inner pressure of the can increases, because the area extending from the opening part over the secondary-score is expanded and deformed when the inner pressure of the can increases, instead of expanding and deforming the opening part larger than the other part in the upper surface of the can lid main body.

However, the invention merely expands and deforms all of the area from the opening part over the secondary-score, and does not increase the gap between the upper surface of the can lid main body and the pull-up part of the tab. In addition, Japanese Examined Utility Model Application No. 7-44595 has disclosed an invention in which a bead is formed at a location opposed to the pull-up part of the tab in the upper surface of the can lid main body. However, in such a constitution, there is a possibility that the tab and the bead come into contact with each other due to the vibration which acts on the can when transferring the can, thereby breaking the main score which demarcates the opening part.

In order to solve the above problem concerning the opening performance of a can lid, the inventors of the present invention thoroughly conducted research and have found the reason why the distance between the lower surface of the pull-up part and the upper surface of the can lid main body decreases. When an opening part is formed on the upper surface of the can lid main body, in particular when a part of the main score is formed to the coining part, a metal on the upper surface of the can lid main body which is located between part of the main score and the rivet flows toward a rivet side, thereby slanting the rivet to another part side of the tab (side opposed to the opening part across the rivet), and simultaneously, the one end part of the tab which is fixed to the rivet moves upward, whereas another end moves downward and slants so as to decrease the distance between the lower surface of the pull-up part and the upper surface of the can lid main body. That is, they have formulated a hypothesis that the distance between the pull-up part of the tab and the upper surface of the can lid main body had already decreased in the simplicial can lid before being wound and fastened to the opening of a can body, and hence it was as difficult as ever to insert one's finger into the gap between the upper surface of the can lid main body and the pull-up part of the tab before or after an inner pressure is applied. It should be noted that it was confirmed that the angle of the slanting should not be less than 4° from the center line which is across rectangularly the upper surface of the con lid main body, as a simplicial can lid.

Under such an opinion, as a means to prevent the slanting of the rivet, it can be proposed to provide a constitution of forming a score or a coining part for preventing the slanting of rivet onto a portion which is opposed to the opening part across the rivet in the upper surface of the can lid main body. A can lid which resembles to such a constitution has been disclosed in, for example, Japanese Patent (Granted) Publication No. 3,468,548; Japanese Unexamined Patent Application, First Publication No. 8-164935; Japanese Unexamined Patent Application, First Publication No. No. 8-11882.

First, Japanese Patent (Granted) Publication No. 3,468,548 has disclosed a can lid, which is equipped with a secondary score which radially extends from the center part of the upper surface of the can lid main body to the outer periphery at a part which is opposed to the opening part across the rivet in the upper surface of the can lid main body, in order to provide a can lid whereby the contents are easily consumed. The part which is surrounded by the secondary-score is located of a position which faces to the lower surface of the one end part of the tab when the tab is rotated in a plane which is horizontal to the upper surface of the can lid main body, and as a result, when the other end part is pulled up after rotating the tab as mentioned above, then the part surrounded by the secondary-score is pushed by one end so as to be opened, thereby accommodating one end inside the can through the opening part.

However, the can lid has a problem in that the compressive strength and the impact resistance may deteriorate, because part of the secondary-score must be located at a coining part in order to open the part surrounded by the secondary-score.

Next, Japanese Unexamined Patent Application, First Publication No. 8-164935 has disclosed a can lid in which a secondary score is disposed as an easily-bent portion on an opposite location to an opening part across a rivet in the vicinity of a rivet where stress is likely to be concentrated when a content filled can falls. This can lid can prevent stress from being concentrated at the main score by dispersing stress which acts the vicinity of the rivet due to impact upon being dropped or water impact action, thereby preventing the main score from bending deformed and generating cracks.

However, the secondary-score disclosed in Japanese Unexamined Patent Application, First Publication No. 8-164935 is formed in the vicinity of a rivet which is adjacent to the rivet in the upper surface of the can lid main body, and hence the secondary-score may be located in the coining part, thereby it is not possible to securely prevent the deterioration in compressive strength and impact strength of a can lid due to the provision of the secondary-score.

Moreover, Japanese Unexamined Patent Application, First Publication No. No. 8-11882 has disclosed a can lid which is equipped with plural secondary scores in the vicinity of a rivet, each of which has been formed to be linear so as to surround the rivet, thereby forming an easily-bent and deformed part in the vicinity of the rivet so as to reduce an initial pulling force for opening an opening part by pulling a pull-up part up.

However, these secondary scores may be located on a coining part, as shown in FIG. 2 of Japanese Unexamined Patent Application, First Publication No. No. 8-11882, and hence it is not possible to securely prevent the deterioration in compressive strength and impact strength of a can lid, similar to Japanese Unexamined Patent Application, First Publication No. 8-164935 above.

SUMMARY OF THE INVENTION

The present invention was made, taking these circumstances into consideration, and it is an object of the present invention to provide a can lid which is capable of having one's finger easily inserted into a gap between the upper surface of the can lid main body and the pull-up part of the tab, and equipped with excellent opening performance, without deteriorating the compressive strength and impact strength of a can lid.

In order to solve these problems and attain the object, the present invention provides a can lid including a rivet which is formed gibbously and upwardly, an opening part demarcated by a main score on an upper surface of a can lid main body, a tab being fixed to the rivet such that one end thereof overlaps the opening part, and a coining part which is located in the vicinity of the rivet and formed to be harder than the other part of an upper surface and a lower surface of the can lid main body excepting the vicinity of the rivet which is adjacent to the rivet on the upper surface and the lower surface of the can lid main body, wherein a rivet-slanting inhibitor part, which flows a metal of the can lid main body located between the rivet to the rivet side thereby correcting or preventing the slanting of the rivet, is formed on a location in an area opposite to an opening part across the rivet in a plane view of the can lid main body, except for the coining part.

In accordance with the present invention, the metal of the can lid main body which is located between a main score and a rivet flows to a rivet side when a main score is formed, thereby it becomes possible to correct or prevent the slanting of the rivet by flowing the metal of the can lid main body which is located between the rivet-slanting inhibitor part and the rivet, even in the case in which the rivet is slanted to the other end side of the tab, or the rivet starts to be slanted.

Accordingly, by disposing the main score, one end of the tab fixed to the rivet moves upwardly, whereas the other end moves downwardly so as to slant the tab, thereby inhibiting the decrease of the distance between the lower surface of the other end and the upper surface of the can lid main body. And as a result, it becomes possible to insert one's finger into a gap between the lower surface and the upper surface so as to provide a favorable opening performance to the can lid.

In addition, since the rivet-slanting inhibitor part is formed by bypassing the coining part in the opposite area, deterioration in compressive strength and impact strength of the can lid can be prevented, even if the rivet-slanting inhibitor part is constituted from, for example, a score or an emboss. Here, since the coining part is formed to be very hard, if the rivet-slanting inhibitor is formed on the coining part so as to flow a metal of the can lid main body to the rivet side in order to correct the slanting of the rivet, then it may be necessary to reduce the residual thickness by increasing the depth of the rivet-slanting inhibitor, and hence the rivet-slanting inhibitor will be easily broken in such a can lid even if the slanting of the rivet could be corrected. And as a result, the compressive strength and impact strength may deteriorate.

Here, the rivet-slanting inhibitor may be located so as to abut on the outer periphery of the rivet in a plane view of the can lid main body.

In this case, it becomes possible to prevent a new slanting from generating in the direction across the direction of correction or prevention when correcting or preventing the slant of the rivet as mentioned above, thereby securely providing the action and effect in the above.

In addition, the rivet-slanting inhibitor may be equipped with a metal flowing part which is located on an opposite side across from said rivet to a starting point of the main score located on the coining part, and a metal damming part located on both sides of the metal flowing part.

In this case, since the rivet-slanting inhibitor is equipped with the metal flowing part and the metal damming part located on both sides of the metal flowing part, it becomes possible to prevent the metal flow radially inward which has been directed to the rivet side when forming the metal flowing part from dispersing into the circumferential direction by the metal damming part. Accordingly, it becomes possible to prevent a new slant from generating in a direction across the direction of correction or prevention when correcting or preventing the slanting of the rivet as mentioned above, thereby securely providing the action and effect in the above.

Moreover, the rivet-slanting inhibitor may be a circular score or a circularly embossed part which is formed gibbously outward and radially in a plane view of the can lid main body, and the top of the circle is located on an opposite side across the rivet to the starting point of the main score located on the coining part.

In this case, it becomes possible to act the metal flow derived from the formation of the rivet-slanting inhibitor on the outer periphery side of the lower end of the rivet over a sufficiently circumferential long area, and to prevent stress from being condensed into the rivet-slanting inhibitor.

In particular, if the rivet-slanting inhibitor is located in such a way that a virtual straight line bonding both ends of the circle arc passes the outer periphery of the rivet, then it is possible for both ends of the rivet-slanting inhibitor to serve as the metal damming part.

Instead of such a rivet-slanting inhibitor , it is possible to provide the can lid in which the rivet-slanting inhibitor is a circular score or a circularly embossed part which is formed gibbously inwardly and radially in a plane view of the can lid main body, and the top of the circle is located at an opposite side across the rivet to the starting point of the main score located at the coining part, the can lid in which the rivet-slanting-inhibitor is a linear score or a linearly embossed part which extends in a width direction of the opening part or the tab in a plane view of the can lid main body, and located on an opposite side across the rivet to the starting point of the main score located on the coining part, or the can lid in which the rivet-slanting inhibitor is a plurality of linear scores or linearly embossed parts which extend diametral direction of the can lid main body in a plane view of the can lid main body, each of which is disposed circularly at an interval and at least a part thereof is located on an opposite side across the rivet to the starting point of the main score located on the coining part.

Here, the rivet-slanting inhibitor may be located in an area between a circle having a radius of 3 mm around the center axis of the can lid main body and a circle having a radius of 8 mm around the center axis of the can lid main body.

There may be a case in which the coining part is located inside an area of a circle having a radius of 3 mm, and if the rivet-slanting inhibitor is disposed inside an area of a circle having a radius of 3 mm, then it is not possible to securely prevent the deterioration in compressive strength and impact strength of the can lid derived from the formation of the rivet-slanting inhibitor. In addition, even if the rivet-slanting inhibitor is disposed outside an area of a circle having a radius of 8 mm, the metal flow derived from formation of the rivet-slanting inhibitor hardly acts on the rivet, and as a result, it is not possible to correct or prevent the slanting of the rivet.

In addition, the rivet-slanting inhibitor may be located 0.01 mm or more from the outer periphery of the coining part.

If the rivet-slanting inhibitor is located less than 0.01 mm from the outer periphery of the coining part, the compressive strength or the impact strength of the can may deteriorate.

Moreover, the rivet may be slanted toward another end of the tab by an angle ranging from 0° to 3.5° from the central axis of the can lid main body. Furthermore, the rivet may be slanted toward another end of the tab by an angle ranging from 0° to 2.0° from the central axis of the can lid main body, when the inner pressure of a can obtained by winding and fastening a can lid to a can body is set to be 0.2 MPa.

In these cases, it is possible to insert one's finger easily into a gap between the upper surface of the can lid main body and the lower surface of the other end of the tab.

Here, it is also possible to provide further a finger-hook recess having a radial inside edge which abuts the other end of the tab, which is formed radially outward to form in at a portion of the opposite area, and an auxiliary score or an auxiliary emboss which is formed radially outside the rivet-slanting inhibitor and radially inside the radial inside edge of the finger-hook recess.

In this case, since the auxiliary score or the auxiliary emboss is formed, it becomes possible to prevent the metal of the can lid main body which is located on radially outward portion to the rivet-slanting-inhibitor part from flowing radially outwardly.

Accordingly, when the rivet-slanting inhibitor is formed, it becomes possible to accelerate the radially inward flow to the rivet-slanting inhibitor, that is the flow toward the rivet side of the metal of the can lid main body located on the rivet side, thereby securely preventing the slant of the rivet.

Moreover, the rivet-slanting inhibitor may be constituted from a score or an emboss having a residual thickness ranging from 0.25 to 0.75 times the thickness of the can lid main body.

In this case, the slant of the rivet can be prevented and the deterioration in compressive strength of the can lid can be securely prevented.

Here, in the case in which the rivet-slanting inhibitor is a score or an emboss formed by pressing the surface of the can lid main body, if inner pressure of the can, which is produced by winding and fastening the can lid onto an opening of a can body, is increased, then the can lid will deform in such a way that the width (i.e. a dimension in a direction rectangularly across the direction with which the rivet-slanting inhibitor extends) or the diameter of the rivet-slanting inhibitor expands so as to further flow the metal of the can lid main body located between the rivet-slanting inhibitor and the rivet to the rivet side. Thereby it becomes possible to further decrease the slant of the rivet due to the formation of the main score, in the case of increasing the inner pressure in the can above, i.e. in the case of a positively pressured can. And as a result, it is possible to provide a particularly favorable opening performance.

In accordance with the present invention, it is possible to prevent the slant of the rivet and provide a favorable opening performance, without deteriorating compressive strength and impact strength of a can lid.

BEST MODE FOR CARRYING OUT THE INVENTION

Figure 1A:
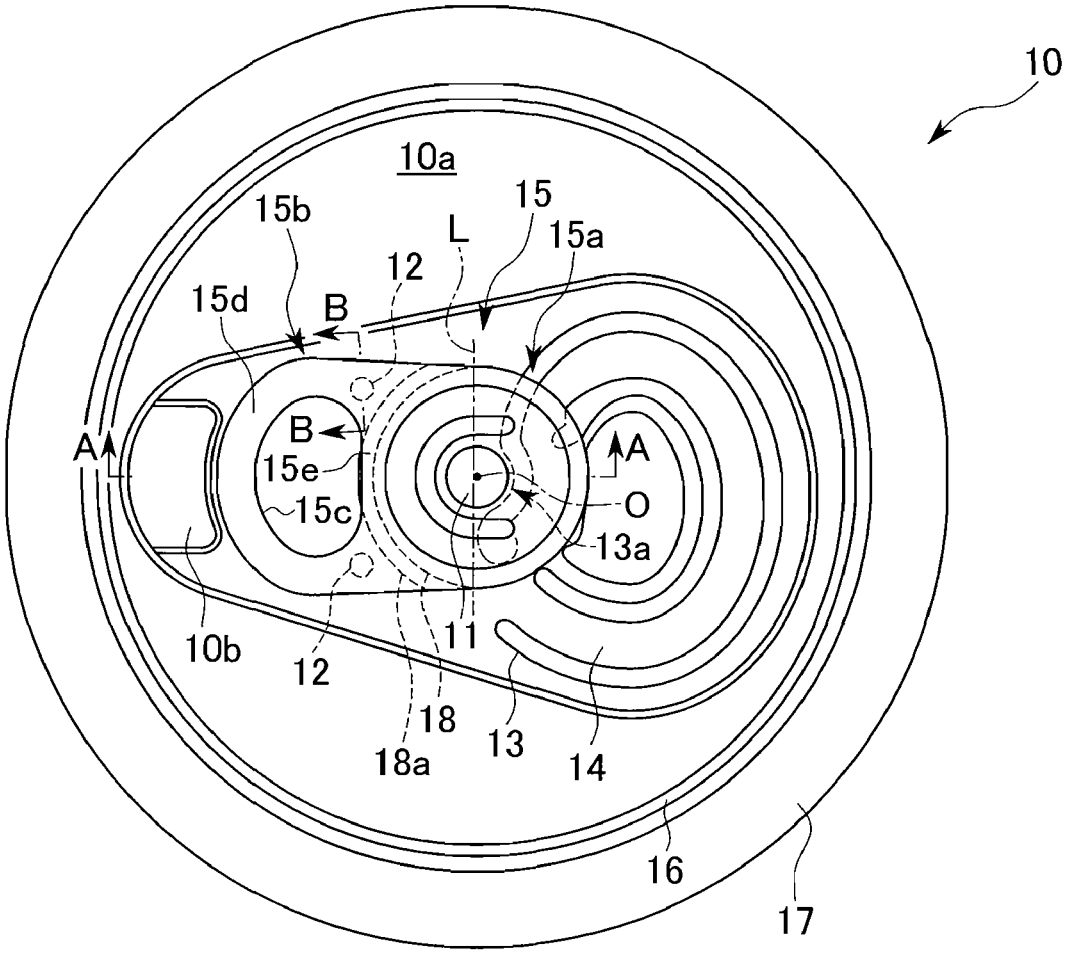
FIG. 1A is a plane view of the can lid of an embodiment of the present invention.

An explanation will be given about embodiments of the present invention below, referring to the drawings.

FIGS. 1 to 4 are drawings each of which shows the schematic constitution of a can lid illustrated as an embodiment of the present invention.

This can lid is made of pure aluminum or aluminum alloy, and is constituted from a rivet 11 and a dimple 12 which are formed gibbously and upwardly, and an opening part 14 demarcated by a main score 13, on a can lid main body 10*a* (referred to as "upper surface 10*a*", below) 10*a* of a can lid main body 10, in which the dimple 12 and the opening part 14 are arranged so as to be opposed to each other across the rivet 11. That is, the dimple 12 is arranged on the opposite side to the opening part 14 with the rivet 11 therebetween, and a tab 15 which is fixed to the rivet 11 in such a way that one end thereof 15*a* overlaps the opening part 14, whereas the other end thereof 15*b* overlaps the dimple 12.

Moreover, on the periphery of the upper surface 10*a*, a hollow groove 16 is formed all around the upper surface 10*a*, and a turn-down part 17 is formed, which abuts the periphery of the hollow groove 16, extends up the upper surface 10*a*, and is turned down radially and outwardly.

It should be noted that this can lid is what is known as a stay-on-tab type can lid, of which the outer diameter of the turn-down part 17 of a can in which the turn-down part 17 has been wound and fastened to an opening part of the can body ranges from approximately 50 to 61 mm.

On the other end 15*b* of the tab 15, a finger hole 15*c* which is perforated in the thickness direction of the tab 15 is formed, and a circumferential wall part located on the other end of the tab 15 in the circumferential wall part which demarcates the finger hole 15*c* serves as a pull-up part 15*d* which is pulled up to open the opening part 14 of the can lid.

On the can lid main body upper surface 10*a*, in the area opposed to the opening part 14 across the rivet 11, that is, in an area opposite to the opening part 14 with the rivet therebetween, a finger-hook recess part 10*b* is formed independently from the hollow groove 16, having a radial inner edge which is formed along the periphery of the pull-up part 15*d* of the tab 15.

As for the dimple 12, two dimples 12 are formed on the upper surface 10*a* in such a way that each of these dimples 12 are opposed to each other across a straight line which connects the center part of the opening part 14 or tab 15 in the width direction with a center axis line O of the can lid main body 10. In the circumferential wall part which demarcates the finger hole 15*c* of the tab 15, a lower surface of both ends of the second circumferential wall part 15*e* which is arranged opposed to the pull-up part 15*d* is arranged over these dimples 12.

Figure 1B:
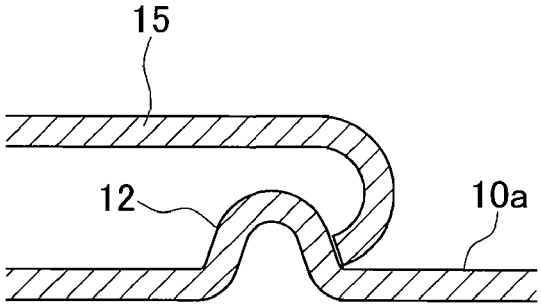
FIG. 1B is a cross sectional view of the can lid shown in FIG. 1A cut through the line B-B indicated by arrows in FIG. 1A.

That is, as shown in FIG. 1B, the dimple 12 is formed at a location where an outer edge on the lower surface in the other end 15*b* of the tab 15 comes into contact with it, thereby rotation of the tab 15 can be prevented, even in the case in which a force to rotate the tab 15 around the center axis line O is applied, because the outer edge of the tab 15 comes into contact with the dimples 12.

Also, in the can lid main body 10 thus constituted, when the tab 15 is fixed to the rivet 11, a nipple part with a shape of upward gibbous is shaped by pressing against the can lid main body member having a plane part at the center in a diametric direction. The resultant nipple part is inserted into a through-hole perforated through the center of the tab 15, and then the nipple part is pressed flat from the upper surface of the can lid main body member to form the rivet 11, and simultaneously the periphery of the tab 15 is pressed so as to fix the tab 15 to the rivet 11.

Here, the nipple part is formed as follows.

First, in the center in a diametric direction of the can lid main body which is shaped as a plane, a bubble is formed to be downwardly gibbous, and thereafter the circumferential part of the bubble, which is extended from the bubble on the can lid main body, is pressed upwardly, while pinching the circumferential part from both the upper surface and the lower surface, and turning it over to form a pre-nipple part and the first coining part 20*b* which is extended from the pre-nipple part and which is ring-shaped from a plane view. It should be noted that the first coining part 20*b* is shaped into a ring with a center at the center axis line O, for example, of which the outer diameter is approximately 9.40 mm and the inner diameter of which is approximately 4.04 mm.

Also, the nipple part and the ring-like second coining part 20*c*, which is connected to the nipple part on the can lid main body and located on the same axis as the first coining part having an outer diameter and inner diameter smaller than those of the first diameter, are formed by pinching a portion which is located inside in a radial direction the periphery of the first coining part, from both the upper side and the lower side, while reducing the outer diameter of the pre-nipple part. Incidentally, the second coining part 20*c* has, for example, an outer diameter of approximately 7.200 mm, and an inner diameter of approximately 3.775 mm.

Next, the nipple part is inserted into a through-hole which is perforated at the center of the tab 15, and the tip of the nipple part is projected from the upper surface of the tab 15. The tip of the nipple part is pressed flat and this part is expanded and deformed, thereby forming the nipple part onto the rivet 11 and simultaneously fixing the tab 15 to the rivet 11. The outer diameter of the rivet 11 is formed no less than 2 mm and no more than 3 mm.

Since the first and the second coining parts 20*b* and 20*c* are formed by pinching both the upper surface and the lower surface of the can lid main body, the first and the second coining parts 20*b* and 20*c* will be harder and thinner than another part of the center part in the radial direction in the upper surface 10*a*. It should be noted that the outer diameter and the inner diameter of the first and the second coining parts 20*b* and 20*c* can be suitably changed according to desired specifications for the can lid.

Figure 2:
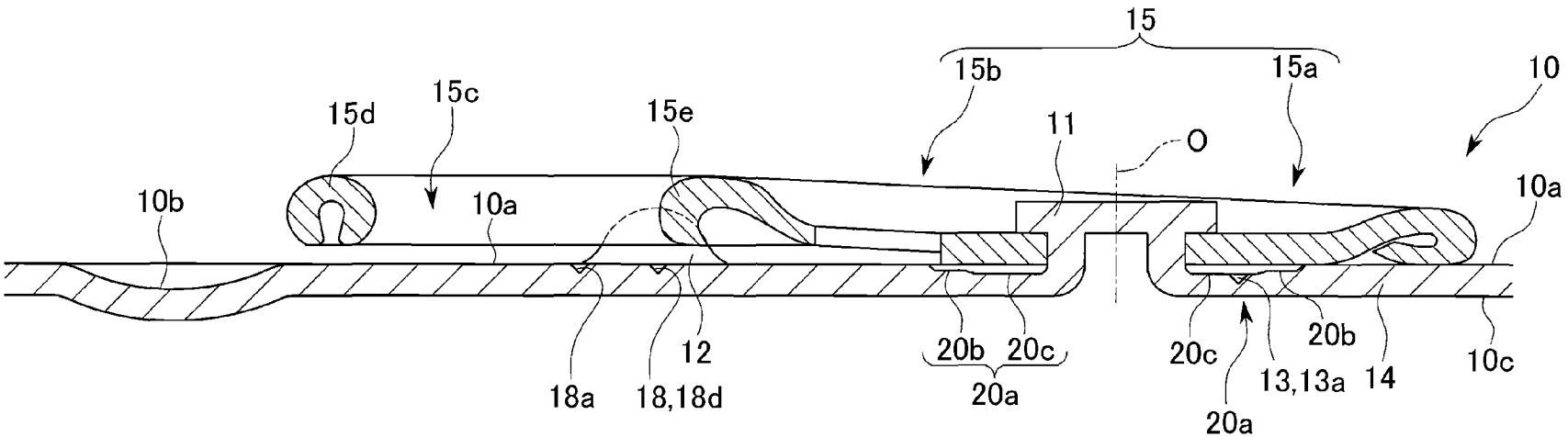
FIG. 2 is a cross sectional view of the can lid shown in FIG. 1A cut through the line A-A indicated by arrows in FIG. 1A.

In the can lid thus constituted, as shown in FIG. 2, the starting point 13*a* of the main score 13 is located on the second coining part 20*c*, such that it can start to break the main score 13 easily at the beginning of pulling the pull-up part 15*d* of the tab 15. In a can lid constructed as above, the second initial point region 13*a* of the main score 13 is located as shown in FIG. 2 by coining region 20*c*, increase region 15*d* of tab 15 was raised, it is original, and it is put, and it gets possible to begin to make main score 13 break easily.

In accordance with this embodiment, plane view rivet-slanting inhibitor 18 is formed, at an area opposite to the opening part 14 across the rivet 11 in the plane view of the can lid main body upper surface 10*a* i.e., the location excepting the second coining part 20*c* of the area being opposed to the opening part 14 with the rivet therebetween, which flows the metal of the can lid main body 10 which is located between the rivet 11 is flowed toward the rivet so as to correct or prevent the installing of the rivet 11.

Although, as the rivet-slanting inhibitor 18, for example, a score or an emboss which is formed by pressing the upper surface 10*a* and the lower surface 10*c* of the can lid main body, or both the upper surface 10*a* and the lower surface 10*c* of the can lid main body can be adopted, an explanation about the case of adopting a score in this embodiment will be given.

The rivet-slanting inhibitor 18 in this embodiment is arranged along the periphery of the rivet in a plane view of the upper surface 10*a*, in the example illustrated in the drawing, the rivet-slanting inhibitor 18 shaped into a circular arc projecting outwardly in a radial direction is arranged in such a way that a substantially straight line L which connects both ends of the circular arc should pass through the outer circumferential edge of the rivet 11. Moreover, the rivet-slanting inhibitor 18 is located in such a way that the top of the circular arc should be opposed to the starting point 13*a* of the main score 13 across the rivet 11, and shaped into a circular arc which extends toward the opening part 14.

In addition, the rivet-slanting inhibitor 18 is located in an area between a circle having a diameter of 3 mm and a circle having a diameter of 8 mm around the center axis line O. Moreover, the rivet-slanting inhibitor 18 is located apart from the periphery of the first coining part 20*b* by no less than 0.01 mm and no more than 6.00 mm, in this embodiment.

In addition, the rivet-slanting inhibitor 18 is formed independently from the main score 13 so as not to be in contact with the main score 13, in an area which is demarcated by an angle ranging from 70° to 190° which is shared equivalently to a straight line which connects the center portion in the width direction of the opening 14 or the tab 15 with the central axial line O.

Moreover, the top of the rivet-slanting inhibitor 18 is located under the second circumferential wall 15*e* arranged opposite to the pull-up part 15*d* of the circumferential wall 15*e* which separates the finger hole 15*c* so as to involve a projection line of the rivet 11 in a direction running from the starting point 13*a* of the main score 13 to the rivet 11 in the plane view of the can lid main body 10. Moreover, in this embodiment, the rivet-slanting inhibitor part 18 is formed to be a single circular arc (a radius of approximately 7 mm) around the center axis line O, and continuous over the whole area in the width direction which is opposed to the lower surface of the tab 15 on the upper surface 10*a*. In addition, the rivet-slanting inhibitor 18 is arranged so as to be equivalently shared to a straight line which connects the center axis line O with the center portion of the tab 15 or the opening part 14 in the width direction.

Moreover, in this embodiment, an auxiliary score 18*a* is formed along the rivet-slanting inhibitor part 18 at a location which radially outward with respect to the top of the rivet-slanting inhibitor and radially inward with respect to the radial inner edge of the finger-hook recess 10*b* in the opposite area. The auxiliary score 18*a* in this embodiment is constituted from a single circular arc around the center axis line O, and is located so as to be equivalently shared to a straight line which connects the center axis line O with the center portion of the tab 15 or the opening part 14 in the width direction. Moreover, the auxiliary score 18*a* is located along over the whole length of the rivet-slanting inhibitor 18.

Figure 3:
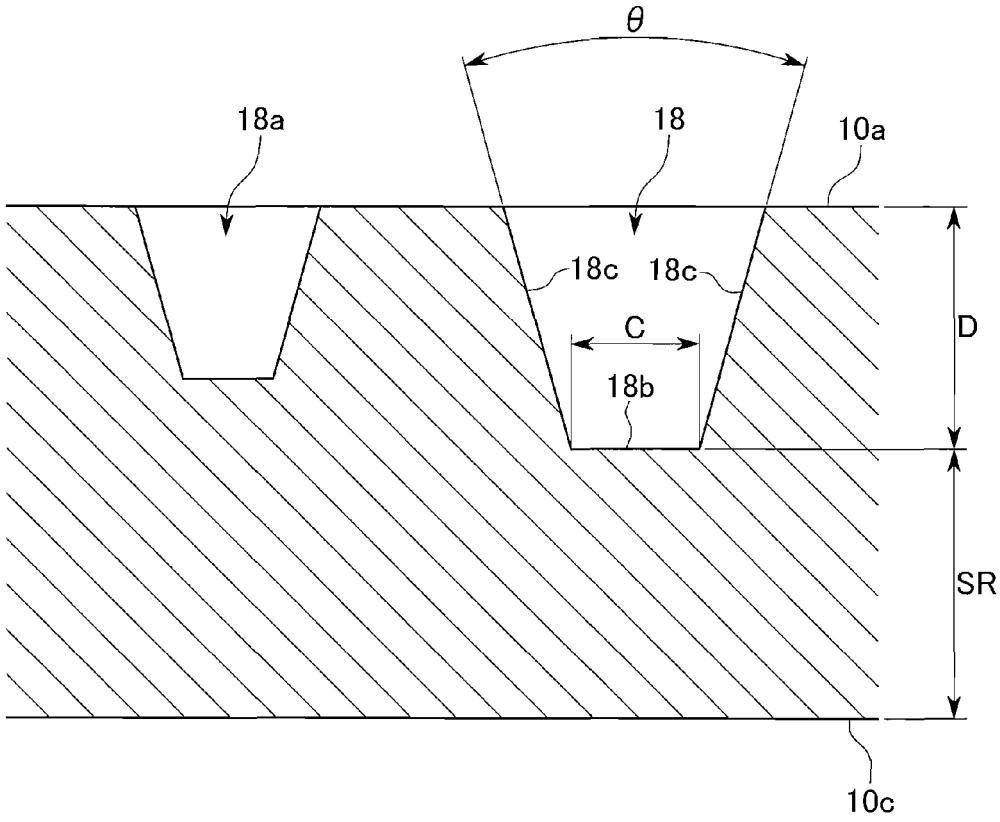
FIG. 3 is a partially enlarged view of the can lid shown in FIG. 2.

The rivet-slanting inhibitor 18 is formed in such a way that the full length should be no less than 10 mm, and that the score residual (remaining thickness), i.e. the distance between the bottom surface 18*b* of the rivet-slanting inhibitor 18 and the lower surface 10*c* of the can lid main body 10 (referred to as "SR value" below) should range from 0.05 mm to 0.24 mm when the thickness of the can lid main body 10 ranges from 0.20 mm to 0.32 mm, as shown in FIG. 3, that is it ranges from no less than 0.25 times to no more than 0.75 times of the thickness of the can lid main body 10.

Moreover, the width C of the rivet-slanting inhibitor 18 ranges from 0.035 mm to 0.12 mm. More preferably, the rivet-slanting inhibitor 18 has such a dimension that the SR value should be approximately 0.140 mm, the width C in the bottom surface 18*b* should be approximately 0.035 mm, the distance (depth) D between the can lid main body upper surface 10*a* and the bottom surface 18*b* should be approximately 0.140 mm, and the angle θ which is formed between the abrupt side walls 18*c* and 18*c* facing each other, arising from the bottom surface 18*b* toward the can lid main body upper surface 10*a* should be approximately 65°.

It should be noted that the main score 13 has a depth ranging from 0.08 to 0.13 mm, and a width ranging from approximately 0.035 mm. That is, the rivet-slanting inhibitor 18 has a width of no less than that of the main score 13 and a depth of no more than that of the main score 13 so as not to be easily breakable even if the rivet-slanting inhibitor 18 is made of a score or an emboss. Moreover, the width of the main score 13 and the rivet-slanting inhibitor 18 indicate the most distant part apart from the can lid main body upper surface 10*a* in a direction of recessing the same, that is a dimension in a direction perpendicular to the direction on which each of the main score 13 and the rivet-slanting inhibitor part 18 extends to the bottom surface.

If the rivet-slanting inhibitor 18 and the main score 13 are formed as above, then the rivet 11 will slant toward the other end 15*b* of the tab 15 with an angle ranging from no less than 0° to no more than 3.5° to the center axis line O of the can lid main body 10, and the rivet 11 will slant toward the other end 15*b* of the tab 15 with an angle ranging from no less than 0° to no more than 2.0° to the can axis or the center axis line O of the can lid main body 10 when the inner pressure of the can in which the can lid main body 10 has been wound and fastened is adjusted to 0.2 MPa.

In addition, the auxiliary score 18*a* has a depth shallower than that of the rivet-slanting inhibitor 18 by no less than 0.020 mm and no more than 0.100 mm.

As explained in the above, in accordance with the can lid of this embodiment, the metal of the can lid main body located between the main score 13 and the rivet 11 flows toward the rivet 11 side when the main score 13 is formed, and as a result, the metal of the can lid main body 10 located between the rivet-slanting inhibitor 18 and the rivet 11 flows toward the rivet side, because the rivet-slanting inhibitor 18 is formed, even when the rivet 11 slants toward the other end 15*b* of the tab 15, or when the rivet 11 starts to slant, thereby it becomes possible to correct or prevent the slanting of the rivet 11.

Thus, as a result of forming the main score 13, the one end 15*a* of the tab 15 which is fixed to the rivet 11 moves upwardly, whereas the other end 15*b* moves downwardly, so as to slant the tab 15, thereby preventing the decrease of the distance between the lower surface of the other end 15*b* and the upper surface 10*a*, such that it becomes possible to insert one's finger into a gap between the upper surface and the lower surface so as to provide favorable opening performance of the can lid.

Moreover, since the rivet-slanting inhibitor 18 is formed at a location excepting the first and the second coining parts 20*b* and 20*c* of the opposite area, it can be possible to prevent the deterioration of compressive strength and the impact strength of the can lid, even if the rivet-slanting inhibitor 18 is made of a score or an emboss.

Moreover, since the rivet-slanting inhibitor 18 is arranged so as to be along the periphery of the rivet 11 in a plane view of the can lid main body 10, it becomes possible to prevent a new slant from generating in the direction crossing the direction along which the correction or prevention is performed when correcting or preventing the slant of the rivet 11. Thereby, it becomes possible to securely provide the prevention.

In addition, the rivet-slanting inhibitor part 18 is shaped into a circular arc which projects outwardly in a radial direction in a plane view of the can lid main body 10, and the top of the circular arc is arranged opposite to the starting point 13*a* of the main score 13 across the rivet 11, and hence the top in the above of the rivet-slanting inhibitor 18 will serve as a metal-flowing part 18*d* which flows the metal of the can lid main body 10 toward the rivet 11, and simultaneously another part which is adjacent to the metal-flowing part 18*d* and located on both sides thereof will serve as a metal-damming part 18*e* which prevents the metal flow caused by the metal-flowing part 18*d* from dispersing into circumferential directions.

Thereby, it is possible to prevent a new slant from generating in the direction crossing the direction along which the correction or prevention is performed, when correcting or preventing the slanting of the rivet by forming the rivet-slanting inhibitor 18. As a result, it is possible to securely provide the prevention. It should be noted that the metal-damming part 18*e* is arranged between the metal-damming part 18*d* and the rivet 11 on both sides of the metal-flowing part 18*d*.

Furthermore, since the rivet-slanting inhibitor part 18 is shaped into a circular arc, it becomes possible to suppress the concentration of stress into the rivet-slanting inhibitor 18 even when a score or an emboss formed by pressing the can lid main body in the thickness direction serves as the rivet-slanting inhibitor 18, thereby securely suppressing the deterioration of the strength of the can lid.

In addition, the rivet-slanting inhibitor part 18 is arranged in such a way that the top thereof is located opposite to the starting point 13*a* of the main score 13 across the rivet in a plane view of the can lid main body, and that the straight line which connects both ends of the circular arc with each other passes through the periphery of the rivet, and hence it becomes possible to effect the metal flow of the can lid main body derived from the formation of the rivet-slanting inhibitor 18 over a sufficient circumferential area outside the periphery of the lower end of the rivet 11, and to effect favorably both ends of the rivet-slanting inhibitor 18 as the metal-damming part 18*e*, thereby securely providing favorable opening performance of the can lid.

In addition, since the rivet-slanting inhibitor 18 is formed as the score or the emboss in the above in this embodiment, if an inner pressure is increased in the can constituted by winding and fastening the can lid to the opening of the can body, then the rivet-slanting inhibitor 18 will be deformed so as to expand the width of the can lid (a dimension in the direction perpendicular to the direction with which the rivet-slanting inhibitor part extends), and as a result, the metal of the can lid main body 10 located between the rivet-slanting inhibitor part 18 and the rivet 11 will be further flowed toward the rivet.

Thereby, it becomes possible to reduce further slanting of the rivet 11 derived from the formation of the main score 13 in the case in which the inner pressure is increased in the can constituted as above, that is in the case of a positive pressure can, and as a result, it becomes possible to provide particularly favorable opening performance.

In addition, since the auxiliary score 18*a* is formed outward in a radial direction of the opposite area, it becomes possible to prevent the metal of the can lid main body 10 located outward in the radial direction of the rivet-slanting inhibitor 18, from flowing outward in the radial direction, when the rivet-slanting inhibitor 18 is formed.

Thus, it becomes possible to promote flowing toward the rivet 11 of the metal of the can lid main body 10 located inside the rivet-slanting inhibitor 18 in a radial direction, (i.e. on the rivet 11 side) when the rivet-slanting inhibitor 18 is formed, thereby, securely inhibiting the slanting of the rivet 11.

In addition, since the rivet-slanting inhibitor part 18 is shaped so as to have a remaining thickness ranging from no less than 0.25 times to no more than 0.75 times the thickness of the can lid main body 10, it is possible to inhibit the slanting of the rivet 11 and securely prevent the deterioration in strength of the can.

Moreover, since the rivet-slanting inhibitor 18 is wholly located in the area between two circles respectively having a diameter of 3 mm and 8 mm, around the center axis line O, and apart from the periphery of the first coining part 20*b* by no less than 0.01 mm and no more than 6.00 mm, the above effect can be securely effected.

Moreover, the rivet 11 slants toward the other end 15*b* of the tab 15 with an angle of no less than 0° and no more than 3.5° to the center axis line O of the can lid main body 10, in addition, the rivet 11 is constituted so as to slant toward the other end 15*b* of the tab 15 with an angle of no less than 0° and no more than 2.0° with respect to the can axis or the center axis line O of the can lid main body 10 when the inner pressure of the can obtained by winding and fastening the can lid onto the opening of the can body is adjusted to 0.2 MPa. Hence one's finger can be easily inserted into the gap between the upper surface 10*a* and the lower surface of the other end 15*b* of the tab 15.

It should be noted that technological scope or the present invention is not limited to the above embodiment, and various changes can be added as long as they do not deviate from the spirit of the present invention.

For example, although the above embodiment is shaped into a circular arc projecting outwardly in a radial direction in a plane view of the can lid main body 10 is shown as the rivet-slanting inhibitor 18 which corrects or prevents the slanting of the rivet 11 by flowing the metal of the can lid main body 10 located between the rivet 11 toward the rivet 11, this is not limiting.

Figure 5:
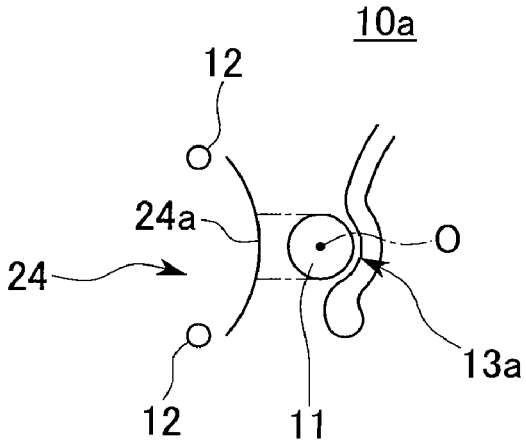
FIG. 5 is a partially enlarged plane view of the upper surface of the can lid main body which is shown as another embodiment of the present invention.

For example, a rivet-slanting inhibitor which is shaped into a circular arc, as shown in FIG. 5, which projects inwardly in a radial direction in a plane view of the can lid main body 10, that is, which projects toward the rivet 11 extending to the other end 15*b* of the tab 15 can be used as the rivet-slanting inhibitor. In addition, the top of the circular arc may be located opposite to the starting point 13*a* of the main score 13 across the rivet 11, so as to involve the projection line of the rivet 11 in the direction toward the rivet 11 from the starting point 13*a* of the main score 13 in a plane view of the can lid main body 10.

Figure 4:
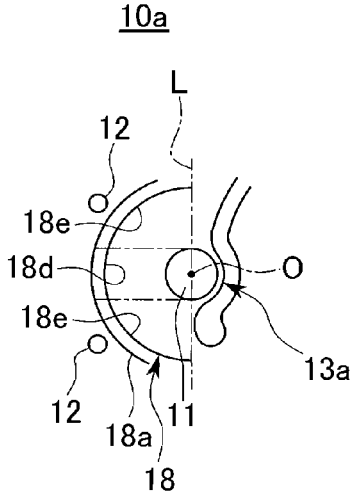
FIG. 4 is a partially enlarged view of the upper surface of the can lid main body shown in FIG. 1A.

In this case, the circular arc preferably has a radius greater than that of the rivet-slanting inhibitor 18, or a circumferential length shorter than that of the rivet-slanting inhibitor 18 shown in FIGS. 1 and 4. In this rivet-slanting inhibitor 24, the top of the circular arc, which involves the projection line of the rivet 11 in the direction toward the rivet 11 from the starting point 13*a* of the main score 13 in a plane view of the can lid main body 10, will serve as a metal-flowing part 24*a*. It should be noted although an auxiliary score is not shown in FIG. 5, the auxiliary score may be formed at a location outside of the rivet-slanting inhibitor part 24 in a radial direction.

Figure 6:
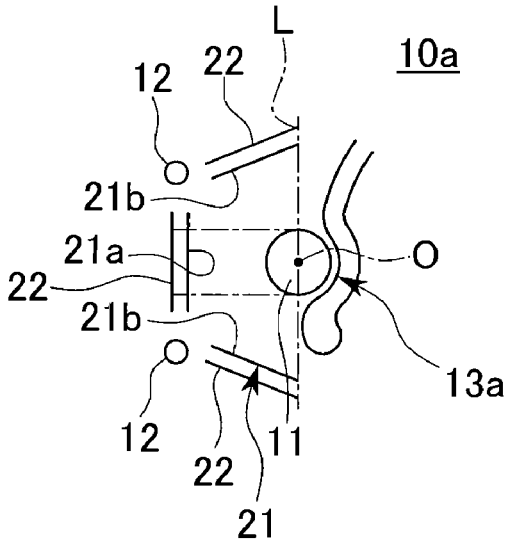
FIG. 6 is a partially enlarged plane view of the upper surface of the can lid main body which is shown as a further embodiment of the present invention.

In addition, as shown in FIG. 6, a rivet-slanting inhibitor 21, which is constituted from plural linear scores or embosses, may be arranged around the rivet so as to be along the periphery of the rivet 11 in a plane view of the can lid main body 10. The rivet-slanting inhibitor 21 shown in FIG. 6 is constituted from three scores or embosses, one of them may be located opposite to the starting point 13*a* of the main score 13 across the rivet 11 so as to be served as a metal-flowing part 21*a*, and the remaining two may be formed between the metal-flowing part 21*a* and the rivet 11 on both sides of the metal-flowing part 21*a*, thereby being served as a metal-damming part 21*b* which prevents the metal flow inwardly in a radial direction caused by the metal-flowing part 21*a* from dispersing into circumferential directions.

In this constitution, it is preferable to provide the center portion in the longitudinal direction of the linear metal-flowing part 21*a* opposite to the starting point 13*a* of the main score 13 across the rivet 11, and to make the dimension of the metal-flowing part 21*a* not shorter than the outer diameter of the rivet 11. That is, it is preferable that the metal-flowing part 21*a* is elongated in the width direction of the opening 14 or the tab 15 in a plane view of the can lid main body 10 and arranged so as to involve the projection line in the direction toward the rivet 11 from the starting point 13*a* of the main score 13. Moreover, a virtual line L which connects both ends at the rivet 11 side of the two metal-damming parts 21*b* formed on both sides of the metal-flowing part 21*a* with each other, i.e. both ends of the rivet-slanting inhibitor part 21 should pass through the periphery of the rivet 11. In addition, it is preferable to locate a linear auxiliary score 22 having a length equivalent to each score or emboss on a portion outside of the three scores or embosses in a radial direction, so as to be parallel to each score or emboss.

It should be noted that each of three scores or embosses may be connected to each other so as to be along the outer circumference of the rivet 11. That is, the rivet-slanting part 21 may be constituted from a metal-flowing part 21*a* extending in the width direction of the opening part 14 or the tab 15 so as to involve the projection line of the rivet 11 in the direction toward the rivet 11 from the starting point 13*a* of the main score 13, and a metal-damming part 21*b* which is connected to both ends of the metal-flowing part 21*a* so as to extend toward the opening part 14, in a plane view of the can lid main body 10.

Figure 7:
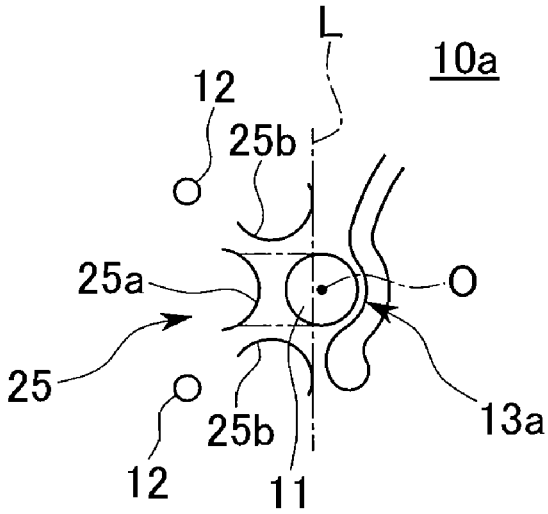
FIG. 7 is a partially enlarged plane view of the upper surface of the can lid main body which is shown as an embodiment of the present invention.

In addition, in the embodiment shown in FIG. 6, each of the metal-flowing part 21*a* and the metal-damming part 21*b* may constitute a rivet-slanting inhibitor 25 shaped into a circular arc projecting inwardly in a radial direction, as shown in FIG. 7. In this case, as shown with two-dot chain line in FIG. 7, the metal-flowing part 25*a* may be located so as to involve the projection line of the rivet 11 in the direction toward the rivet 11 from the starting point 13*a* of the main score 13 in a plane view of the can lid main body 10, while locating the top which forms a circular arc of the metal-flowing part 25*a* opposite to the starting point 13*a* of the main score 13 across the rivet 11. It should be noted that the metal-flowing part 25*a* is preferably located so as to be shared equivalently to a straight line which connects the center axial line O with the center portion in the width direction of the tab 15 or the opening part 14. In addition, the virtual line L which connects both ends with each other at the rivet 11 side of the two metal-damming parts 25*b* formed on both sides of the metal-flowing part 25*a*, that is both ends of the rivet-slanting inhibitor 25 with each other, may be located so as to pass through the periphery of the rivet 11.

It should be noted that instead of the rivet-slanting inhibitor 25 shown in FIG. 7, each of the metal-flowing part 25*a* and the metal-damming part 25*b* may be shaped into a circular arc which projects outwardly in a radial direction. In addition, although an auxiliary score is not illustrated in FIG. 7, the auxiliary score may be formed at a location outside the rivet-slanting inhibitor part 25 in a radial direction. Moreover, the metal-damming part 25*b* may be connected to both ends of the metal-flowing part 25*a* along the periphery of the rivet 11.

Figure 8:
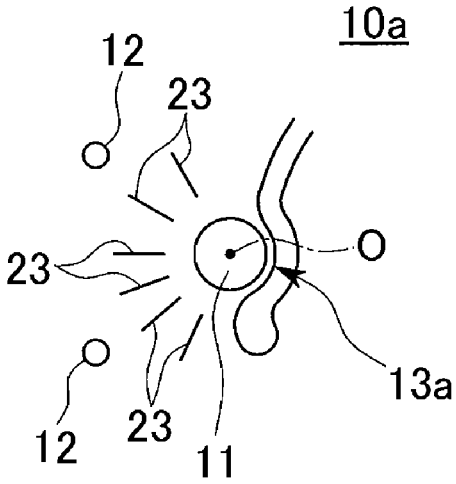
FIG. 8 is a partially enlarged plane view of the upper surface of the can lid main body which is shown as another embodiment of the present invention.

Furthermore, as shown in FIG. 8, plural linear rivet-slanting inhibitor 23 extending in the radial direction of the can lid main body 10 in a plane view of the can lid main body 10 may be formed at regular intervals in the circumferential direction, in such a way that at least part thereof is located opposite to the starting point 13*a* of the main score 13 across the rivet 11. It should be noted that all of the rivet-slanting inhibitor 23 shown in FIG. 8 extend in the direction passing through the center axial line O when the length is extended inwardly in the radial direction. Moreover, although an auxiliary score is not illustrated in FIG. 8, the auxiliary score may be formed on a location outside the rivet-slanting inhibitor 23 in the radial direction.

In addition, although the rivet-slanting inhibitor part 18, 24 and 23, shown in FIGS. 4, 5 and 8; respectively; the metal-flowing part 21*a* and 25*a*, shown in FIGS. 6 and 7, respectively; and the auxiliary score 18*a* and 22, shown in FIGS. 4 and 6, respectively, are shown as embodiments each of which is shaped into a continuously extended member. Instead, for example, each of these members may be isolated, or isolated members and continuously extended members may coexisted. Moreover, these members of 18, 24, 23, 21*a*, 25*a*, 21*b*, 25*b*, 18*a* and 22 are not limited to be formed onto the can lid main body upper surface 10*a*. They may be formed onto the can lid main body lower surface 10*c*, or they may be formed onto both surfaces of 1*a* and 10*c*.

In addition, although the rivet-slanting inhibitor 18, etc. and the auxiliary score 18*a* are illustrated as members having a trapezoidal shape in a cross section, as shown in FIG. 3 in the above embodiment, their shapes are not limited to those in the above embodiment. For example, their shapes may be asymmetrical, a circular arc, or V-shaped.

Moreover, the order of forming the main score 13, the rivet-slanting inhibitor 18, etc., and the auxiliary scores 18*a* and 22 is not particularly limited. For example, if the rivet-slanting inhibitor 18 is formed after forming the main score 13, then the slant of the rivet 11 upon forming the score 13 will be corrected, whereas, if the main score 13 is formed after forming the rivet-slanting inhibitor 18, then the slant of the rivet 11 will be prevented even if the rivet-slanting inhibitor 18 slants upon forming the score 13.

Furthermore, although each of the rivet-slanting inhibitor 18, 21 and 25 shown in FIGS. 4, 6 and 7 are in such a way that the virtual line L which connects both ends thereof with each other passes through the periphery of the rivet 11 in a plane view of the upper surface 10*a*, the rivet-slanting inhibitor part may be located in such a way that the virtual line L passes through the outside of the periphery and the other end 15*b* of the tab 15.

In addition, instead of the auxiliary scores 18*a* and 22, auxiliary embosses 18*a* and 22, which are formed by pinching and embossing the upper surface 10*a* and the lower surface 10*b* of the can lid main body 10, may be used. Furthermore, the auxiliary scores 18*a* and 22, and the auxiliary embosses 18*a* and 22 are not necessarily formed.

In addition, although in each embodiments in the above, the rivet-slanting inhibitor 18, etc. is illustrated located separate from the periphery of the first coining part 20*b* by no less than 0.01 mm and no more than 6.00 mm, instead of this constitution, the rivet-slanting inhibitor 18, etc. may be located separate from the periphery of the first coining part 20*b* by no less than 0.01 mm and no more than 7.00 mm.

That is, the rivet-slanting inhibitor 18, etc. may be formed on a location excepting at least the second coining part 20*c*, and may be formed on the first coining part 20*b*. It should be noted that if the rivet-slanting inhibitor 18, etc. is located apart from the periphery of the first coining part 20*b* by no less than 0.01 mm, i.e. if the rivet-slanting inhibitor 18, etc. is formed on a location excepting not only the second coining part 20*c* but also the first coining part 20*b*, then it will be possible to securely prevent certainly the deterioration of the compressive strength and the impact strength of the can lid derived from the formation of the rivet-slanting inhibitor 18.

In addition, although each of the rivet-slanting inhibitor 18 and the auxiliary score 18*a* shown in FIG. 4 is illustrated as a single circular arc around the center axial line O, the center of the circular arc is not limited to the center axial line O, and each of the rivet-slanting inhibitor 18 and the auxiliary score 18*a* is not limited to a single circular arc. It may be a plurality of circular arcs or a continuing straight line.

Furthermore, although the auxiliary scores 18*a* and 22 are located so as be along whole of the rivet-slanting inhibitors 18 and 21, in the above embodiment, the auxiliary scores 18*a* and 22 may be located so as to be along at least the metal-flowing parts 18*d* and 21*a* of the rivet-slanting inhibitors 18 and 21.

In addition, although the rivet-slanting inhibitor 8, 21 or 25 is equipped with the metal-flowing part 18*d*, 21*a* or 25*a* and the metal-damming part 18*e*, 21*b* or 25*b*, in the above embodiment, the rivet-slanting inhibitor 18, 21 or 25 may be equipped with at least the metal-flowing part 18*d*, 21*a* or 25*a*, respectively.

Moreover, each of the above can lid may be used in not only a positive pressure can but also a negative pressure can.

In addition, the rivet-slanting inhibitor 18, etc. is not limited to one which is made of a score or an emboss, as long as the rivet-slanting inhibitor 18, etc. is capable of flowing the metal of the can lid main body 10 located between the rivet 11, toward the rivet 11.

Here, an examination was performed of the above effects.

As Example 1, a can lid excepting the auxiliary score 18*a* was formed by setting the thickness of the can lid main body 10 to 0.28 mm, and the SR value of the rivet-slanting inhibitor 18 to 0.22 mm, in the can lid shown in FIGS. 1 to 4. In addition, as Example 2, a can lid excepting the auxiliary score 18*a* was formed by setting the thickness of the can lid main body 10 to 0.28 mm, and the SR value of the rivet-slanting inhibitor 18 to 0.17 mm, in the above can lid. In addition, as Example 3, a can lid excepting the auxiliary score 22 was formed by setting the thickness of the can lid main body 10 to 0.28 mm, and the SR value of the rivet-slanting inhibitor 21 to 0.17 mm, in the can lid shown in FIG. 6.

As a Comparative Example, a conventional can lid excepting the rivet-slanting inhibitors 18 and 21, and the auxiliary scores 18*a* and 22 was formed in the above can lid. It should be noted that the thickness of the can lid main body was set to 0.26 mm.

A can was formed by winding and fastening each of these can lids onto an opening of a can body, and then a distance (referred to as a "gap" below) between the lower surface of the pull-up part 15*d* and the can lid main body upper surface 10*a* upon applying an inner pressure to these cans was measured. It should be noted that the outer diameter of the turn-back part of each can was set to approximately 61 mm.

Figure 9:
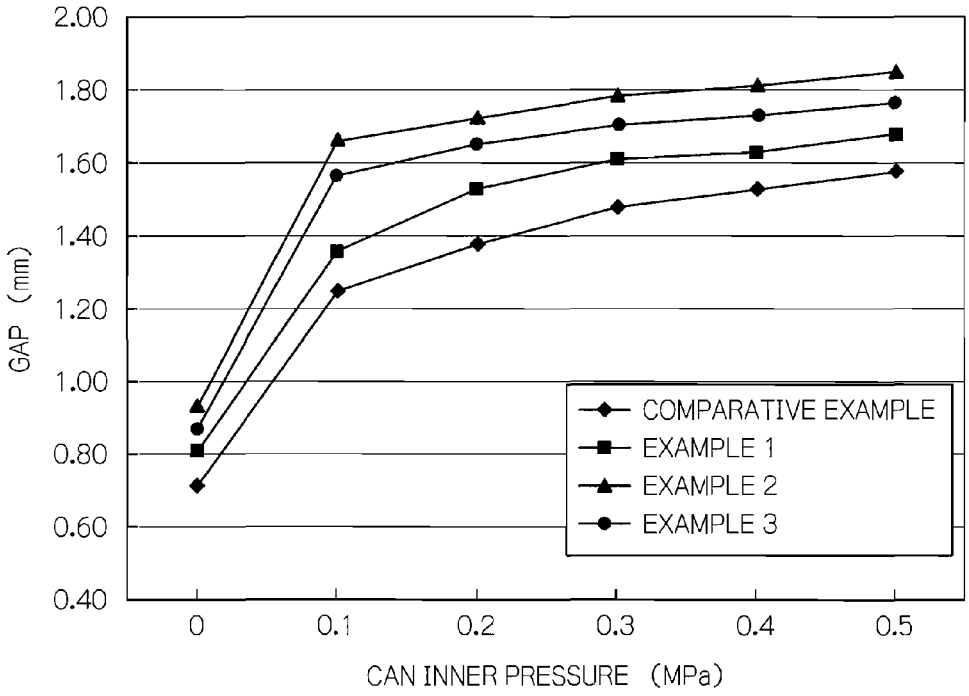
FIG. 9 shows the results of a first test that inspected the action and effects derived from the formation of the rivet-slanting-inhibitor part in a can lid.

As a result, as shown in FIG. 9, the gap in the Comparative Example is smaller than that of each of Examples 1 to 3, regardless of the inner pressure of the can, and it was confirmed that favorable opening performance could be provided to the can by forming the rivet-slanting inhibitors 18 and 21 on the can lid.

Next, the inner pressure of each of the cans in Examples 1 and 2, and Comparative Example was increased to 0.55 MPa, and then was reduced to atmospheric pressure, and thereafter was increased to 0.20 MPa. At this time, the gap was measured at each inner pressure.

Figure 10:
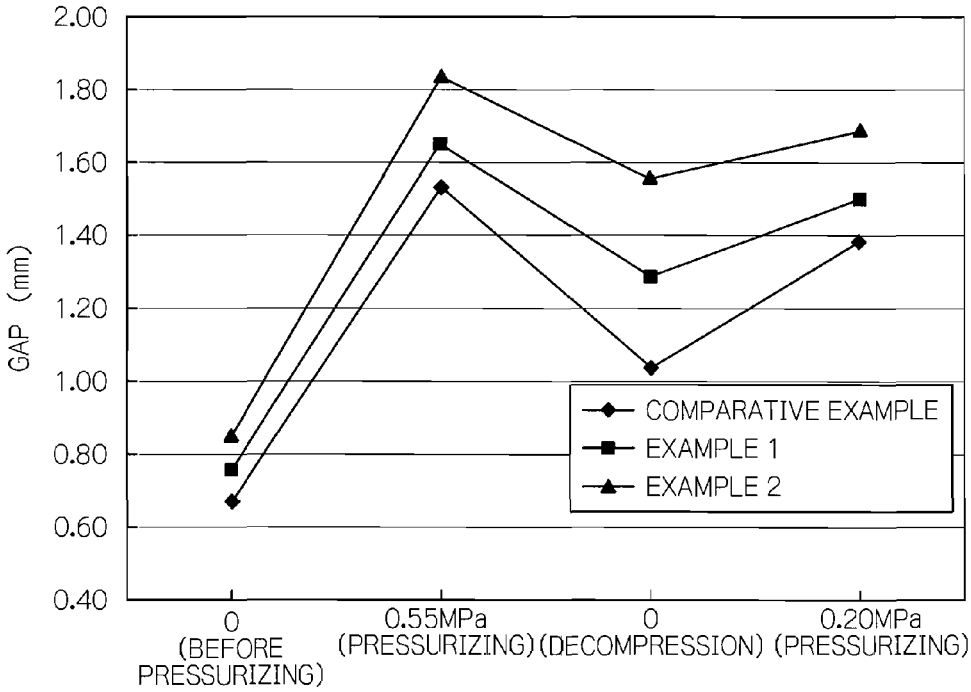
FIG. 10 shows the results of a second test that inspected the action and effects derived from the formation of the rivet-slanting-inhibitor part in a can lid.

As a result, as shown in FIG. 10, it is confirmed that the gap in the Comparative Example is smaller than that in each of Examples 1 and 2, regardless of the change in the inner pressure values of the can. In particular, in Examples 1 and 2, it is confirmed that favorable opening performance can be provided to the can lid by forming the rivet-slanting inhibitor 18 on the can lid, even when the inner pressure of the can is varied, for example even in the case in which retort-disinfect treatment is conducted.

In addition, in the can lid in Example 2, an angle formed between the rivet 11 and the center axial line O of the can lid main body 10 on the side of the other end 15*b* of the tab 15, that is the rivet-slanting angle, was measured, as approximately 3°. After winding and fastening this can lid onto an opening of a can body to form a can, an inner pressure of 0.2 MPa was applied to the can and the rivet slanting angle at that time was measured as approximately 1.0°.

On the other hand, it was confirmed that the rivet slanting angle of the above conventional can lid was approximately 4.0°, and that the rivet slanting angle when an inner pressure of 0.2 Pa was applied to a can which was formed using the can lid was approximately 4.0°.

Thus, it was confirmed that if the inner pressure increases in the can lid of Example 2, i.e. in the case of a positive pressure can, the rivet slanting angle will be further reduced, and a gap between the lower surface of the other end 15*b* of the tab 15 and the upper surface 10*a* will become larger, thereby it becomes possible to insert one's finger into the gap easily.

A can lid which is capable of inhibiting the slanting of the rivet and providing favorable opening performance without deteriorating compressive strength and impact strength of the can lid is provided.

The invention claimed is:

1. A can lid comprising:

a rivet which is formed gibbously and upwardly;

an opening part demarcated by a main score on an upper surface of a can lid main body;

a tab being fixed to the rivet such that one end part thereof overlaps the opening part; and a coining part which is located in the vicinity of the rivet on the upper surface and a lower surface of the can lid main body, said coining part being shaped into a ring around the rivet and being formed harder than another part of the upper surface and the lower surface of the can lid main body, wherein a rivet-slanting-inhibitor is formed on the upper surface of the can lid outside the coining part on the side of the rivet opposite the opening part and the main score, said rivet-slanting inhibitor being generally formed in the shape of a concentric arc about the rivet and the coining part, such that the slanting of the rivet is prevented.

2. The can lid as set forth in claim 1, wherein said rivet-slanting inhibitor further comprises:

a metal flowing part which is located on the side across from said rivet opposite to a starting point of said main score located on said coining part; and a metal damming part located on both sides of the metal flowing part.

3. The can lid as set forth in claim 1, wherein said rivet-slanting inhibitor is a circular score or a circularly embossed part which is formed gibbously outward and radially in a plan view of said can lid main body.

4. The can lid as set forth in claim 1, wherein said rivet-slanting inhibitor is located in an area between a circle having a radius of 3 mm around the center axis of the can lid main body and a circle having a radius of 8 mm around the center axis of the can lid main body.

5. The can lid as set forth in claim 1, wherein said rivet-slanting inhibitor is located 0.01 mm or more from the outer periphery of said coining part.

6. The can lid as set forth in claim 1, wherein said rivet is slanted toward the other end part of said tab by an angle ranging from 0° to 3.5° from the central line of said can lid main body.

7. The can lid as set forth in claim 1, wherein said rivet is slanted toward the other end part of said tab by an angle ranging from 0° to 2.0° from the central line of said can lid main body, when the inner pressure of a can obtained by winding and fastening a can lid to a can body is set to 0.2 MPa.

8. The can lid as set forth in claim 1, further comprising: a finger-hook recess having a radial inside edge which abuts on another end of said tab, which is formed radially outward to form a portion of said opposite area, and an auxiliary score or an auxiliary emboss which is formed radially outside of said rivet-slanting inhibitor and radially inside of the radial inside edge of the finger-hook recess.

9. The can lid as set forth in claim 1, wherein said rivet-slanting inhibitor part is constituted from a score or an emboss having a residual thickness ranging from 0.25 to 0.75 times the thickness of said can lid main body.

10. The can lid according to claim 1, wherein the rivet-slanting inhibitor is arranged in such a way that a line connecting both ends of the concentric arc passes through the outer circumferential edge of the rivet.

* * * * *